US007985108B1

(12) United States Patent
Bekker et al.

(10) Patent No.: US 7,985,108 B1
(45) **Date of Patent: *Jul. 26, 2011**

(54) MODULAR DIESEL HYDRAULIC THURSTER SYSTEM FOR DYNAMICALLY POSITIONING SEMI SUBMERSIBLES

(75) Inventors: Joannes Raymond Mari Bekker, Houston, TX (US); Gene Milus Little, Cypress, TX (US)

(73) Assignee: Thrustmaster of Texas, Inc., Houston, TX (US)

( * ) Notice: Subject to any disclaimer, the term of this patent is extended or adjusted under 35 U.S.C. 154(b) by 483 days.

This patent is subject to a terminal disclaimer.

(21) Appl. No.: 12/243,780

(22) Filed: Oct. 1, 2008

(51) Int. Cl.

| | |
|---|---|
| ***B63H 21/165*** | (2006.01) |
| ***B63H 5/125*** | (2006.01) |
| ***B63H 21/12*** | (2006.01) |
| ***B63H 23/26*** | (2006.01) |
| ***B63H 25/42*** | (2006.01) |
| ***B63B 35/44*** | (2006.01) |

(52) U.S. Cl. ..... 440/5; 440/53; 440/61 S; 114/144 R; 114/144 B; 114/150; 114/265

(58) Field of Classification Search ..... 114/144 R, 114/144 B, 150, 265; 440/5, 6, 53, 58–60, 440/61 R, 61 S See application file for complete search history.

(56) References Cited

U.S. PATENT DOCUMENTS

| | | | | |
|---|---|---|---|---|
| 4,358,280 | A * | 11/1982 | Jeanson et al. | 440/61 R |
| 4,436,050 | A | 3/1984 | Liden | |
| 4,580,517 | A * | 4/1986 | Lundberg | 114/144 R |
| 4,634,389 | A * | 1/1987 | Eptaminitakis | 440/53 |
| 4,878,864 | A * | 11/1989 | Van Bentem | 440/5 |
| 5,403,216 | A | 4/1995 | Salmi et al. | |
| 5,491,636 | A | 2/1996 | Robertson et al. | |
| 6,247,421 | B1 | 6/2001 | Ludwigson | |
| 6,257,165 | B1 | 7/2001 | Danos, Jr. et al. | |
| 6,378,450 | B1 | 4/2002 | Begnaud et al. | |
| 6,439,936 | B1 * | 8/2002 | Dreith et al. | 440/54 |
| 6,453,838 | B1 | 9/2002 | Mowell et al. | |
| 6,668,746 | B1 | 12/2003 | Schia et al. | |
| 6,672,236 | B1 | 1/2004 | Pinsof | |
| 6,712,654 | B1 * | 3/2004 | Putaansuu | 440/53 |
| 6,848,380 | B1 | 2/2005 | Sainz | |
| 6,848,382 | B1 | 2/2005 | Bekker | |
| 7,055,447 | B1 | 6/2006 | Bekker | |
| 7,806,065 | B1 * | 10/2010 | Bekker et al. | 114/144 B |

FOREIGN PATENT DOCUMENTS

| | | | |
|---|---|---|---|
| JP | 59075900 | A * | 4/1984 |

* cited by examiner

*Primary Examiner* — Ajay Vasudeva

(74) *Attorney, Agent, or Firm* — Buskop Law Group, P.C.; Wendy Buskop

(57) ABSTRACT

A removable retractable externally mountable dynamic positioning self contained diesel hydraulic thruster system for a floating semi-submersible vessel having a hull with a ballasted waterline, a first pontoon integral with the hull and a second pontoon integral with the hull. The hull supports a deck, wherein the system comprises: at least a pair of azimuthing thrusters, wherein at least one azimuthing thruster is removably mounted to a pontoon of a semi-submersible vessel.

9 Claims, 6 Drawing Sheets

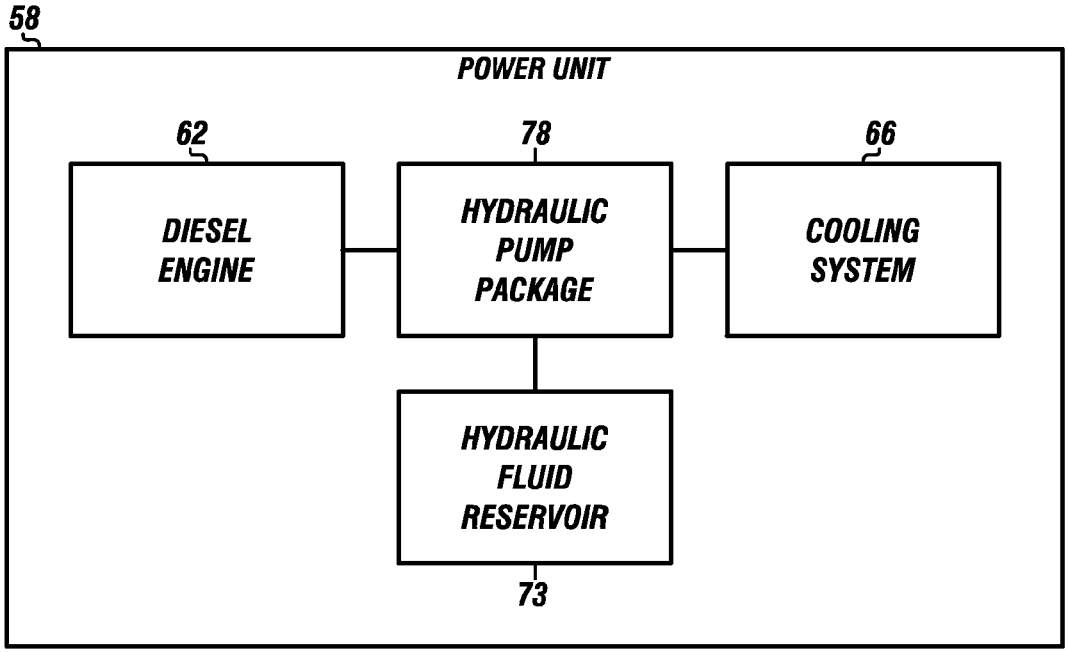
FIGURE 6
FIGURE 7
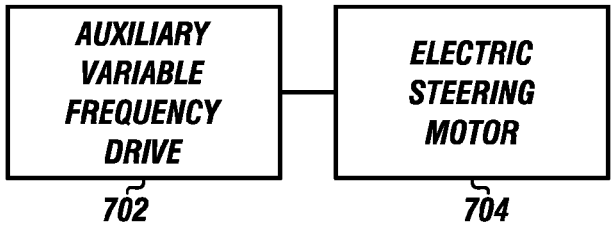

MODULAR DIESEL HYDRAULIC THURSTER SYSTEM FOR DYNAMICALLY POSITIONING SEMI SUBMERSIBLES

FIELD

The embodiments relate to an integrated positioning and maneuvering system removably mounted on a semi-submersible and portability and installation methods that provide deployed and elevated (service or maintenance) positions of the thrusters and their self-contained power systems and controls relative to a semi-submersible.

BACKGROUND

Semi-submersible vessels used in offshore oil operations can be large cumbersome vessels that need to be kept steady over a well site. They also need to be repositionable relative to certain defined coordinates. A need has existed for a removable and portable system for dynamically positioning semi-submersibles without the need for anchors, winches, or any type of anchor mooring device.

As oil and gas exploration is extending farther offshore into deeper water there is a need to make the semi-submersibles more mobile. Although for several years, a semi-submersible might sit in one location, they are mobile, and a need has existed for a way to move these massive structures.

Even in some shallow water areas, the use of anchor mooring systems may be prohibited, for instance, due to the presence of coral reefs or in locations where there already are multiple pipe lines and cables on the ocean floor and the use of anchors could damage the coral reefs or break existing pipe lines and cables.

A portable positioning system with portable thrusters, self-contained power units and a dedicated control system has long been needed, where the thrusters, power units and controls are not integral with any of the semi-submersible's systems or are integral with the hull of the semi-submersible and allow easy attachment to a pontoon at sea and easy removal at sea when the system is no longer required. A portable system is needed that can be removable such that it can reinstalled intact on another semi-submersible. This way, the thruster system can be leased to instead of owned by an operator, and at least theoretically lowering the cost of exploring for oil and gas, lowering the cost for a consumer.

Additionally, a need has existed for a modular system that can easily be increased or reduced in overall size and capacity to suit semi-submersible vessels of different sizes.

Additionally, a need has existed for a fully packaged, self-contained thruster system that is fully integrated, factory tested and class approved before installation on the semi-submersible, allowing vessel upgrades to dynamic positioning capability within just a short period of time, less than 3 months and as short as 60 days, at minimal cost, and a significant reduction from the 6 months to 1 year currently needed to retrofit semi-submersibles.

Additionally, a need has existed for a system which is easy to service at sea allowing minimal down time without the need for a semi-submersible to return to a yard or dry dock, allowing the semi-submersible to continue operating at its work location without interruption, hence increasing the profitability of the operation.

BRIEF DESCRIPTION OF THE DRAWINGS

The detailed description will be better understood in conjunction with the accompanying drawings as follows:

FIG. 6 depicts a schematic of a portion of a power unit according to one or more embodiments.

FIG. 7 depicts a schematic of an auxiliary variable frequency drive driving at least one electric steering motor according to one or more embodiments. An auxiliary variable frequency drive operatively connected to an electric steering motor.

Figure 1A:
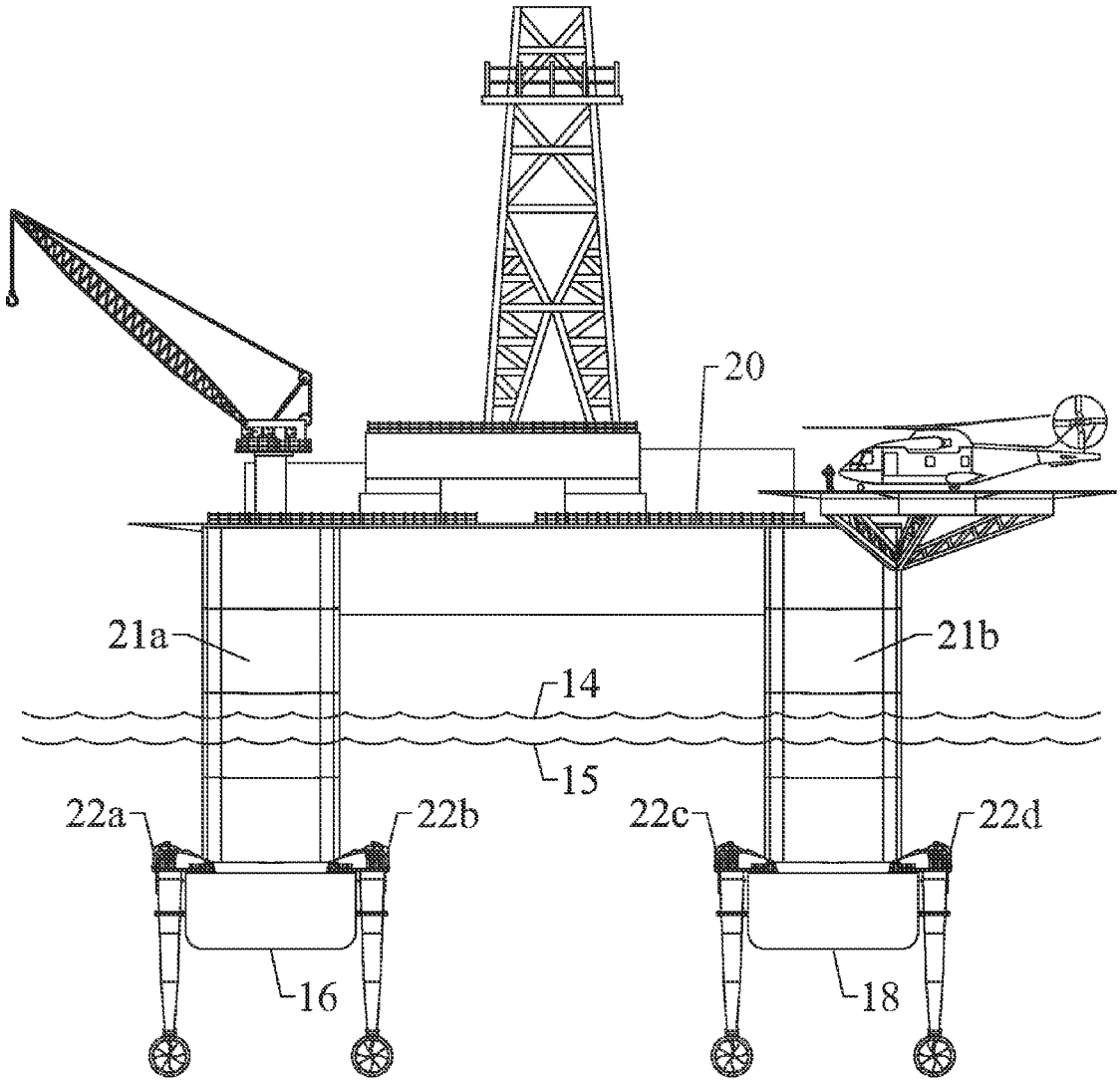
FIG. 1A depicts a front view of a semi-submersible multiple thrusters located thereon.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The embodiments relate to a removable externally mountable diesel hydraulic thruster system for dynamic positioning of a floating semi-submersible vessel having a hull with a ballasted waterline. The vessel as at least one submerged pontoons, and typically 2, 3, or 4 pontoons. Columns are secured to the tops of the pontoons and deck can be attached to the columns.

In an embodiment, it is contemplated that at least one pair of azimuthing thrusters can be secured to each pontoon of the semi-submersible. The thrusters can be mounted to the pontoons by skids. An upper housing can be removably connected to skid. The skid can be a flat plate, or U shaped, or H shaped, depending on the shape of the pontoon at the point of attachment.

The upper housing can be connected to the skid using threaded fasteners. A tube can be secured to the upper thruster housing. The tube extends to the hydraulic pod which supports the propeller and nozzle.

In an embodiment each pair of azimuthing thrusters can be removably mounted to opposite sides of the pontoons, and each pontoon can have from about 1 pair of azimuthing thrusters up to about 15 pairs, but more likely 2 to 8 pairs of azimuthing thrusters per pontoon for optimum dynamic positioning by an operator.

If no skid is used for the mounting of the thrusters, then the upper thruster housing can be removably mounted to the sides of the pontoons.

In an embodiment, when a skid is used, the upper thruster housing can be hinge mounted to the skid and hydraulic cylinders allow the hydraulic tilt of the upper thruster housing, the tube and the hydraulic pod with propeller and nozzle.

The upper thruster housing can have a slewing bearing with at least one hydraulic motor driven slewing drive, at least one electric steering angle feedback sensor, and a multi-port hydraulic swivel assembly.

The tube mentioned above, can be connected to the upper thruster housing at one end and can be removable secured to a hydraulic pod at an opposite end. The tube should be hollow to allow for lower weight and ease of transport in addition to providing a conduit for the communication cables.

The tube can have a length that is long enough to extend the propeller below the pontoon. The inner diameter of the tube can range from about 12 inches to about 120 inches. In another embodiment, the tube can be a tapered configuration.

The tube connects to the hydraulic pod, which can be made from steel to protect the contents of the hydraulic pod from weather. The hydraulic pod contains a hydraulic motor. A propeller drive shaft is connected to the hydraulic motor and drives a fixed pitch propeller. The propeller provides a variable thrust for the azimuthing thruster system. The propeller can be a three, four or five blade propeller.

The propeller can be a three, four or five blade propeller. A nozzle that can be a tapered housing around the propeller is secured to the hydraulic pod and surrounds the propeller.

A bundle of hydraulic hoses can connect on one end to the multiport hydraulic swivel assembly and on the other end to the hydraulic motor.

At least one pair of diesel hydraulic power units are removable secured to the vessel, and are above the ballasted waterline. Each power unit engages an azimuthing thruster.

Each power units has a power unit housing or enclosure that is made of steel or a similar stiff metal. The power unit housing should be weather tight.

The power unit has a hydraulic pump package driven by a diesel engine. At least one hydraulic pump is connected to the engine and engages the motor. The hydraulic pump is also in communication with the hydraulic fluid reservoir and a cooler.

The power unit communicates with the slewing drive.

An azimuthing thruster control system is positioned within the power unit housing. The azimuthing thruster control system communicates with the azimuthing drive.

An embodiment of the invention further includes at least one position reference sensor. The position reference sensor is for providing position reference data. The position reference sensor can be a hydro acoustic sensor, a micro-wave sensor, a GPS differential sensor, a taut wire sensor, a reference sensor, or a laser sensor. Other position sensor capable of detecting drift of the vessel from a defined position can be used.

The invention can further include at least one motion reference sensor. The motion reference sensor is used for providing motion reference data. The motion reference sensor can be a motion reference unit that is used to compensate for movement of the vessel due to roll, pitch, or yaw.

The invention also includes at least one heading reference sensor for providing vessel heading data. The heading reference sensor can be a gyro sensor or a magnetic sensor.

The invention can include environmental sensors, such as a wind sensor. The wind sensor measures wind data. The wind data can include wind direction and wind speed.

The invention includes a dynamic positioning system. The dynamic positioning system can receive the position reference data, the motion reference data, the vessel heading data, and wind sensor data, and can send commands to the azimuthing thruster control system to position the vessel according to predetermined coordinates.

The dynamic positioning system can also receive feedback data from each azimuthing thruster control system. The feedback can relate to the variable thrust of the azimuthing drive and the steering angle of the azimuthing drive which then allows for even more accurate positioning.

Figure 1B:
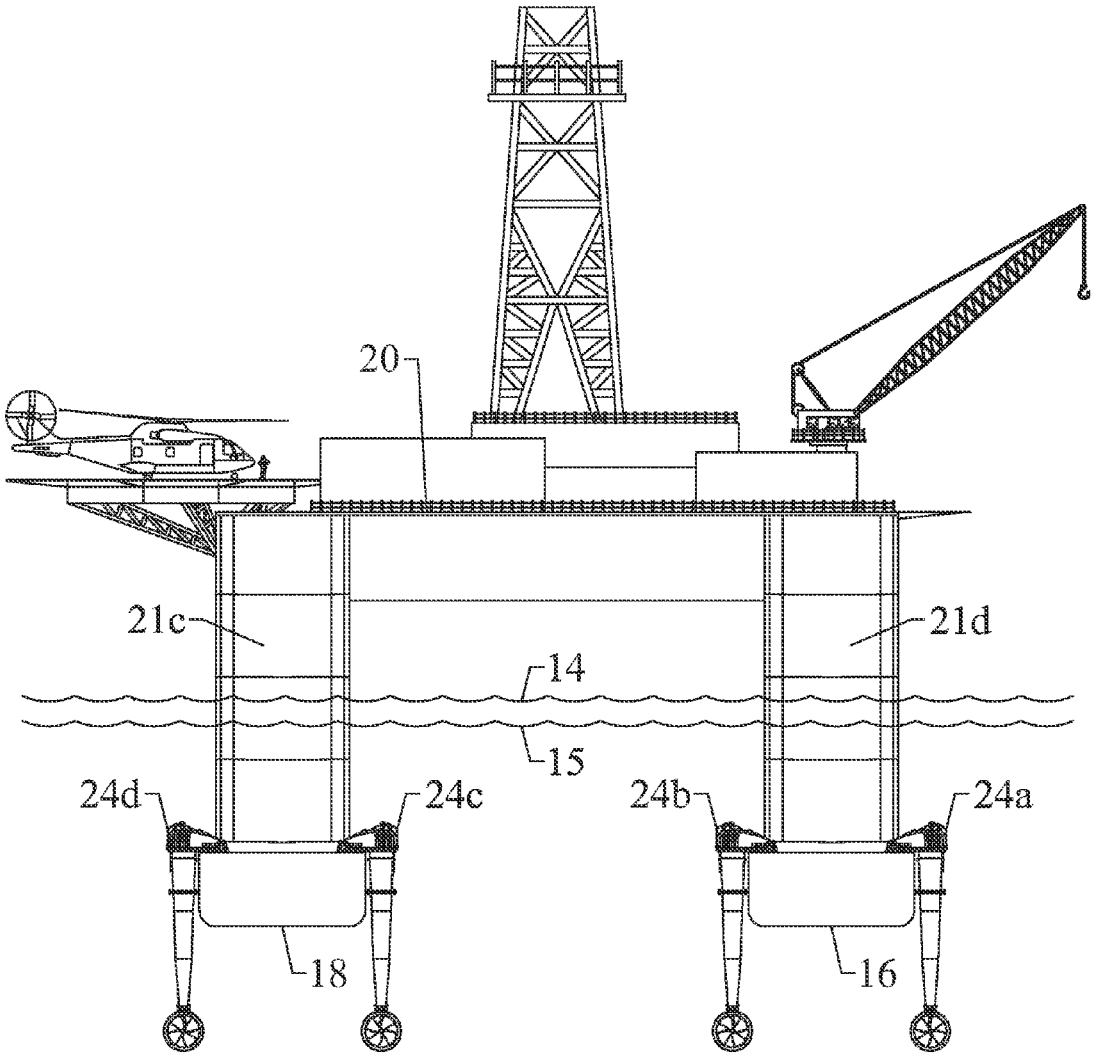
FIG. 1B depicts a back view of a semi-submersible multiple thrusters located thereon.

The system, as shown in FIGS. 1*a* and 1*b*, illustrates a floating semi-submersible vessel 10 with two pontoons and having a ballasted waterline 14, differing from the floating semi-submersible vessel's 10 unballasted waterline 15. A first pontoon 16 parallels a second pontoon 18. Columns 21(*a, b, c, d*) engage the pontoons. A deck 20 is connected to a plurality of columns 21(*a, b, c, d*) which are secured to the top of the pontoons.

FIG. 1A illustrates, a pair of azimuthing thrusters 22(*a*, b) are located at the bow of the first pontoon 16 on the top of the pontoon, and another pair 22(*c*, d) are located at the bow and on the top of the second pontoon 18. FIG. 1B illustrates another pair of azimuthing thrusters 24(*a*, b) on the stern of the first pontoon 16, on the top of the pontoon, and another pair of azimuthing thrusters 24(*c*, d) are located on the top of the second pontoon 18.

In recent years, the drilling operations have been conducted at greater distances from the shoreline, in deep waters over 7,500 feet. It is believed that this embodiment can be used in water depths of about 10,000 feet. It is advantageous to deploy these floating semi-submersible vessels which do not use anchors, as opposed to fixed bottom anchored structures.

Designs of semi-submersible vessels utilize one or more buoyant pontoons or lower hulls, which support at least two vertically extending columns. The upper portion of the columns supports the deck or working platform. Some of the semi-submersibles are a single caisson or column, usually denoted as a buoy while others utilize three or more columns extending upwardly from buoyant pontoons. Two-pontoon, four-column structures have been taught in the art, but there has been no teaching on moving these vessel using removable thrusters.

The thrusters have to take into account roll motion induced by waves, and the inherent stability of the vessel for hostile environments. The embodiments enable a semi-submersible to have improved safety, maneuverability, and versatility, while enabling the thrusters to be used on other vessels in case the semi-submersible is left in position for a long period of time.

These embodiments contemplate that the semi-submersible is positioned at a location using dynamically positioned thruster assemblies mounted on the pontoons.

The thruster assemblies can be retractable and all run from a number of self contained power units.

The pontoons can be divided into a plurality of watertight compartments for accommodating ballast as well as allowing the thruster assemblies to be secured to the top of the pontoons.

The current embodiments relate to installing the thrusters at the top of the pontoons, not at the bottom of the pontoons. Only by installing at the top of the pontoons can the thrusters be removable and installable at sea or dock side without the need for divers or a dry dock. This is a significant advantage from a maintenance standpoint. If one thruster goes out, or the propeller hits a log or other debris floating in the ocean, another can be easily replaced with out significant down time of the vessel.

A feature of the embodiments is that the thrusters can be added onto the semi-submersible after it has been towed to a position then used to keep the vessel in place using 360 degree fixed pitch variable speed azimuthing thruster assemblies.

The heavy weather draft of the semi-submersible (the ballasted draft) is greater than the unballasted level. Not shown in the Figures.

Figure 2:
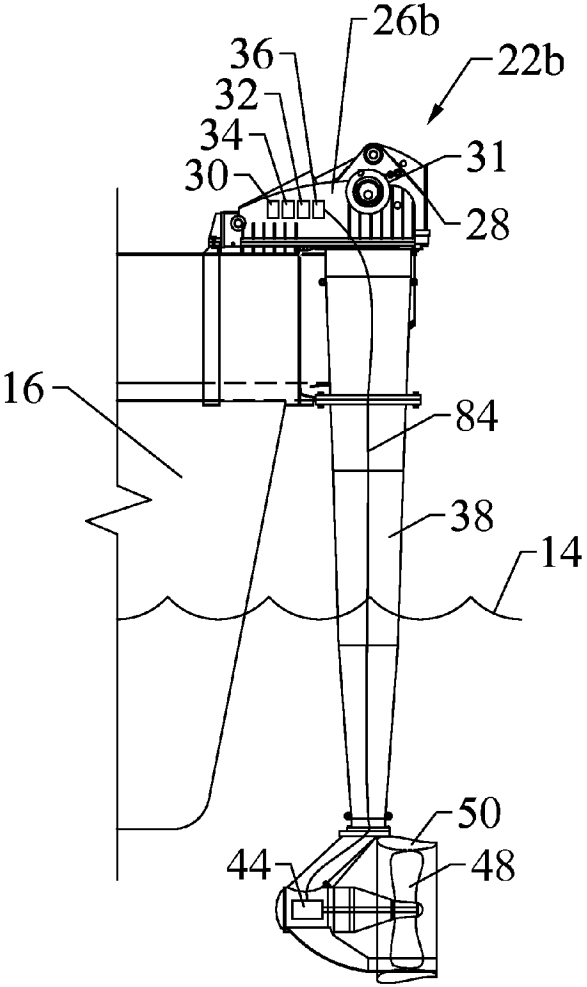
FIG. 2 depicts a side view of a thruster located on the top of a pontoon of a semi-submersible.

FIG. 2 shows a side view of pontoon 16 with the installed azimuthing thruster. The thruster assembly 22*b* includes skid

26*b* removably secured to the pontoon 16 above the ballasted waterline 14. The thruster comprises an upper thruster housing 28 containing a steering motor 30, a hydraulic motor driven slewing drive 32, at least one hydraulic steering angle feedback sensor 34, and a multiport hydraulic swivel assembly 36.

The steering motor 30 can be a hydraulic steering motor 30 which receives power from a diesel driven hydraulic pump package. The steering motor 30 engages the hydraulic motor driven slewing drive 32 for engaging a slewing drive that can effect the rotation of the azimuthing thruster. The multiport hydraulic swivel assembly 36 allows components contained within the rotating portion of the azimuthing thruster to receive hydraulic power from an external stationary position. A hydraulic hose 84, which may be contained within a bundle of hydraulic hoses, is illustrated connecting the multiport hydraulic swivel assembly 36 to the hydraulic motor 44.

A connector 31 removably holds the upper thruster housing 28 to the skid 26*b*. A tube 38 is depicted movably connected to the upper thruster housing and a hydraulic pod 49. The tube 38 can be moveably mounted to the upper thruster housing 28.

Figure 3:
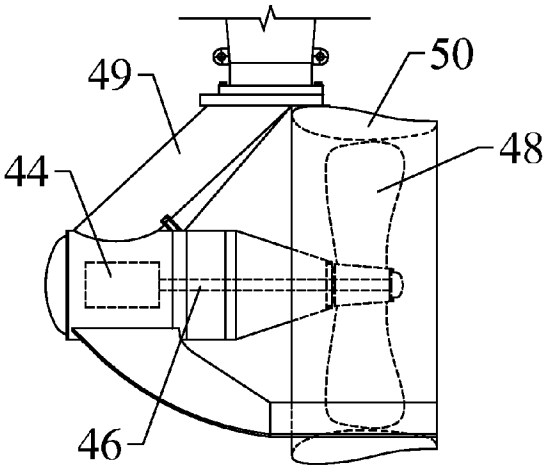
FIG. 3 depicts side view of a hydraulic pod of an azimuthing thruster.

FIG. 3 illustrates a side view of the hydraulic pod 49 having the hydraulic motor 44 connected to the propeller drive shaft 46 which engages and turns the propeller 48. The propeller 48 is surrounded by a nozzle 50, which is secured to the hydraulic pod 49 for increasing the velocity of the fluid moved by the propeller 48.

The hydraulic pod 49 contains a hydraulic motor 44. The hydraulic motor 44 drives a propeller drive shaft 46, which is also contained within the hydraulic pod 49. The propeller drive shaft 46 is secured to a propeller 48. The propeller drive shaft 46 drives the propeller 48 at an RPM proportional to the RPMS of the hydraulic motor.

Figure 4:
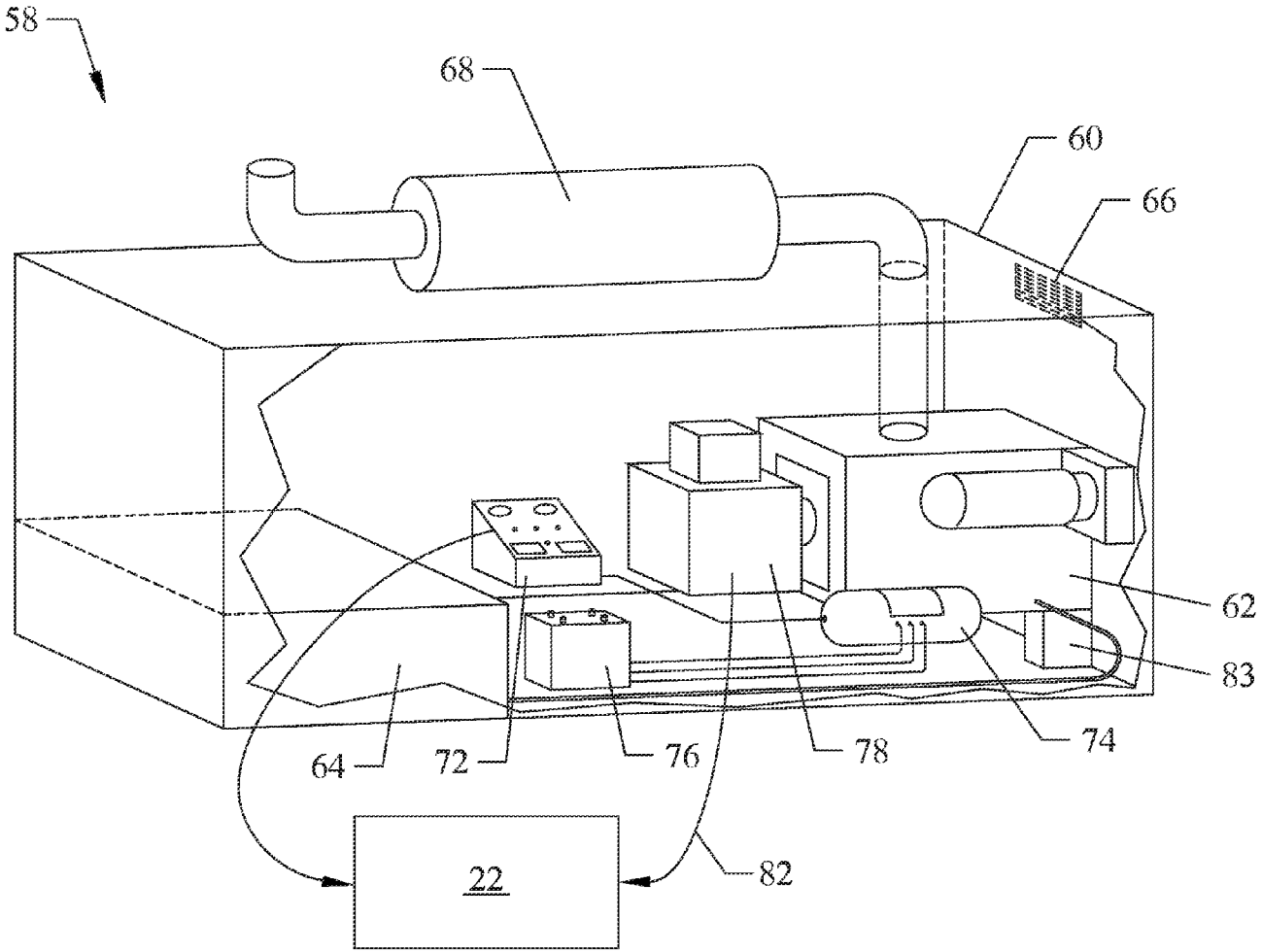
FIG. 4 depicts a perspective view of the interior of the self-contained power unit.

FIG. 4 shows the power unit 58. The diesel hydraulic power unit 58 has a power unit housing 60 removably secured, such as with bolts or other fasteners to the deck of the semi-submersible. The power units 58 can be secured to the vessel above a ballasted waterline 14 (seen in FIGS. 1A and 1B). Each of the power units 58 engage one of the azimuthing thrusters 22. In an alternative embodiment, the power units 58 are interconnected providing a pool of power, which can be distributed to the azimuthing thrusters as needed.

The power unit 58 has a hydraulic pump package 78 driven by a diesel engine 62. The power unit has an exhaust system 68 for venting exhaust produced by the diesel engine, as well as a hydraulic fluid reservoir (best shown below in FIG. 6). FIG. 4, also shows a cooling system 66, a starting system 74, an engine mount 83, and a control system 72. The control system 72 can be an electrical control system 72.

The diesel engine 62 engages a fuel tank 64, a battery 76, and the starting system 74 for starting up and running. The diesel engine 62 drives a hydraulic pump package 78. The hydraulic pump package 78 in turn provides fluid pressure through a hydraulic hose 82 to the azimuthing thruster 22. The hydraulic hose 82 can connect to one side of the multiport hydraulic swivel assembly 36 (seen in FIG. 2) within the azimuthing thruster. There can also be an alternator connected with the diesel engine 62.

The diesel engine 62 can have a horsepower that can range from about 500 horsepower to about 10,000 horsepower.

Figure 5:
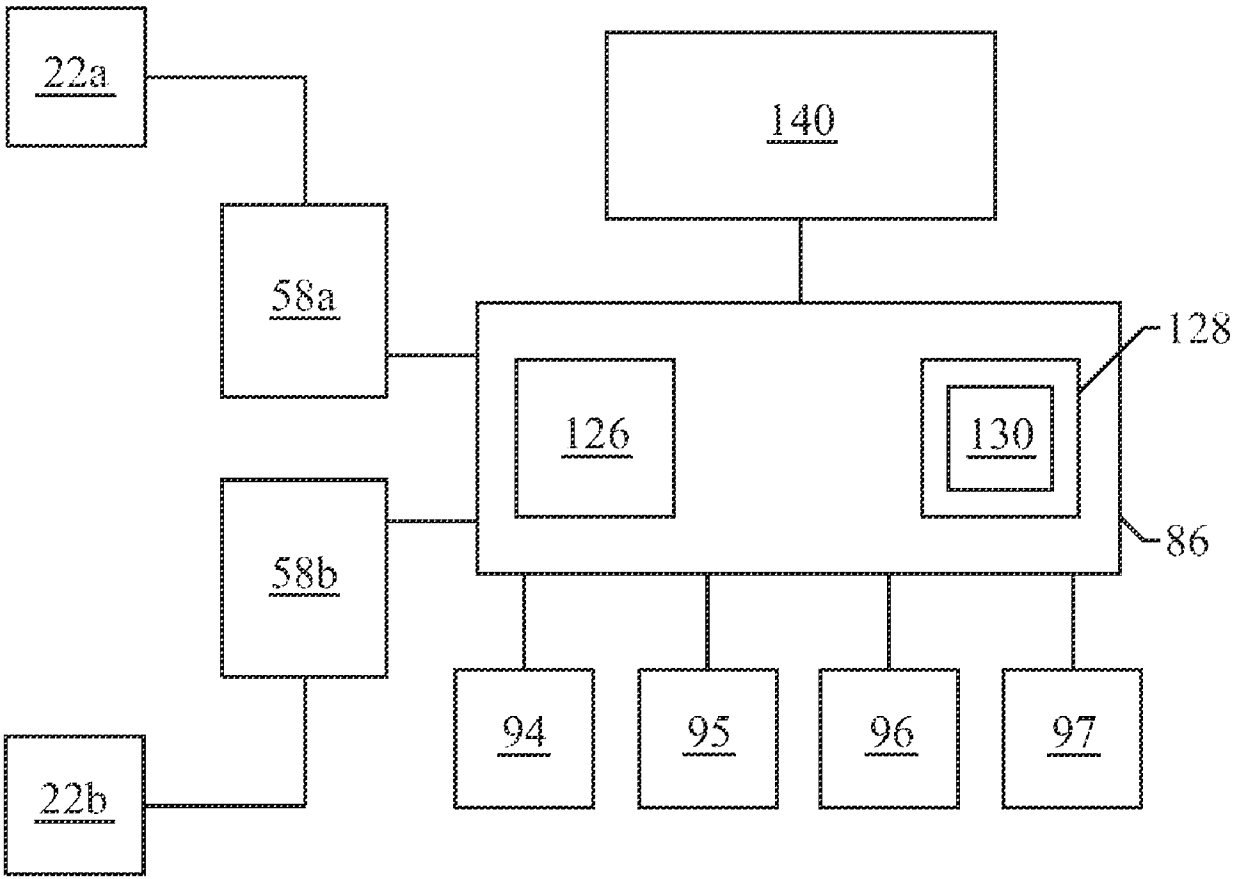
FIG. 5 shows a schematic view of a pair of removable azimuthing thrusters installed on a dual pontoon semi-submersible connected to the self contained power unit and the communication system.

FIG. 5 illustrates a schematic of a pair of removable azimuthing thrusters (22*a, b*) connected to the self contained power units (58*a, b*) in communication with a dynamic positioning system 86. The dynamic positioning system 86 includes a processor 126 in communication with data storage 128 containing computer instructions 130. The dynamic positioning system 86 is adapted to receive position reference data, motion reference data, vessel heading data, and wind data. The dynamic positioning system 86 sends commands to each azimuthing thruster control system (72, seen in FIG. 4) to position the vessel and control heading of the vessel relative to a preset location and heading. The dynamic positioning system 86 can also receive feedback data from each azimuthing thruster control system (72, seen in FIG. 4).

The computer instructions 130 include instructions for taking the sensed data from each sensor and determining how much power what direction each thruster needs to be utilized in order to either maintain the entire submersible in a desired position or to move the submersible to a desired position.

At least one positioning reference sensor 94 can be in communication with the processor 126 of the dynamic positioning system 86 but numerous ones can be used, up to 20 can be used for a single vessel. FIG. 5 illustrates a second positioning reference sensor 96.

The position reference sensors can be one or more of the following sensors: global positioning system (GPS) sensors, differential correction sensors, hydro-acoustic sensors for determining a location relative to a moving underwater target or a fixed point on a sea bottom, fan beam laser sensors for determining a location relative to a fixed structure above the sea, Artimis system signal sensors; vertical taut wire system sensors, horizontal taut wire system sensors or Differential and Absolute Reference Positioning System (DARPS) sensors.

The dynamic positioning system 86 can include at least one uninterruptible power source 140 connected to dynamic positioning system 86.

At least one motion reference sensor 95 obtains motion reference data and provides the motion reference data the dynamic positioning system 86. The motion reference data allows the dynamic positioning system to compensate for movement of the vessel due to roll, pitch, or yaw.

There is also a heading reference sensor for providing vessel heading data to the dynamic positioning system 86. A wind sensor 97 is in communication with the dynamic position system 86 for transmitting the wind data to the dynamic position control system 86.

The dynamic position system 86 receives feedback data from each control system 72. The feedback data can relate to propeller RPM, such as 500 revolutions per minute. The feedback data can also relate to the angle of the azimuthing drive in relation to the vessel heading. For example, the angle of the azimuthing drive would be between 0 and 360 degrees.

When any repairs are needed, an azimuthing thruster can be removed from and returned to service in the shortest time possible. Time consuming dry docking is avoided when addressing a thruster requiring maintenance or repair. Thruster repair or maintenance activities can be pursued while the vessel continues operations or is in transit. The hydraulic cylinders simply lift the thruster out of the water above the deballasted waterline; the thruster can be repaired and then lowered again for operation.

In another embodiment of the system, the tube can be moveable mounted to the upper thruster housing, such as a slewing bearing.

While the presently preferred usage context of the system is dynamic positioning of vessels, barges and other floating structures, it can be used in many forms of seaborne as well as inland waterborne operations or installations, such as dredging, deep sea mining, seismic operations, surveys, pipe and cable laying, subsea construction and repair, salvage and recovery, offshore drilling, military operations, oceanographic research and others, whereby the vessels or structures are or may be required to maintain a desired station or to move in any desired horizontal direction with or without a change of heading.

FIG. 6 depicts a schematic of a portion of a power unit according to one or more embodiments. The power unit 58 can include the hydraulic pump package 78. The hydraulic pump package 78 can be driven by the diesel engine 62. The hydraulic pump package 78 can be in communication with a hydraulic fluid reservoir 73 and a cooling system 66.

FIG. 7 depicts a schematic of an auxiliary variable frequency drive 702 driving at least one electric steering motor according to one or more embodiments. An auxiliary variable frequency drive 702 operatively connected to an electric steering motor.

While these embodiments have been described with emphasis on the embodiments, it should be understood that within the scope of the appended claims, the embodiments might be practiced other than as specifically described herein.

What is claimed is:

1. A modular removable externally mountable diesel hydraulic thruster system for dynamic positioning of a floating semi-submersible vessel with a ballasted waterline comprising at least one submerged pontoon, and wherein each submerged pontoon is provided with at least one vertical column integral with a top of the at least one submerged pontoon, and wherein each vertical column supports a deck above the ballasted waterline, and wherein the modular removable externally mountable diesel hydraulic thruster system comprises:

a. at least a pair of azimuthing thrusters wherein each azimuthing thruster is removably mounted to the at least one submerged pontoon of the floating semi-submersible vessel, and wherein each azimuthing thruster generates a variable thrust and each azimuthing thruster comprises:
   1. a skid removably secured to the top portion of the submerged pontoon below the ballasted waterline;
   2. an upper thruster housing removably connected to the skid, containing a slewing bearing with at least one hydraulic motor driven slewing drive, at least one electric steering angle feedback sensor for indicating the steering angle of the azimuthing thruster and a multiport hydraulic swivel assembly;
   3. a tube moveably connected to the upper thruster housing and removable connected on the other end to a hydraulic pod with nozzle;
   4. a hydraulic motor inside the hydraulic pod with a rotating propeller drive shaft whereby a fixed pitch propeller is removably mounted to a propeller drive shaft that engages the propeller drive shaft; and
   5. a bundle of thruster hydraulic hose assemblies connected to at least one of the hydraulic motors on one end to the multiport hydraulic assembly on the other end;

b. at least a pair of diesel hydraulic power units removably secured to the deck, wherein each diesel hydraulic power unit engages one of the azimuthing thrusters, wherein each diesel hydraulic power unit comprises:
   1. a power unit housing;
   2. a diesel engine driven hydraulic pump package within the power unit housing;
   3. at least one hydraulic fluid reservoir;
   4. a fuel tank connected to the diesel engine;
   5. a cooling system;
   6. a starting system connected to the diesel engine;
   7. an exhaust system connected to the diesel engine;
   8. a bundle of hydraulic hose assemblies, wherein at least one hydraulic hose is connected to the hydraulic motor within the hydraulic pod; and
   9. a control system communicating with the azimuthing thruster;

c. a dynamic positioning system connected to the diesel hydraulic power unit; and d. at least two position reference sensors and at least two environmental reference sensors connected to the dynamic positioning system.

2. The system of claim 1, wherein 1 pair to 15 pairs of azimuthing thrusters are removably mounted to each pontoon.

3. The system of claim 1, wherein the diesel hydraulic power unit is driving at least one hydraulic steering motor or an auxiliary variable frequency drive is driving at least one electric steering motor.

4. The system of claim 1, further comprising at least one engine mount for supporting the diesel engine.

5. The system of claim 1, wherein the position reference sensor is selected from the group consisting of: global positioning system (GPS) sensors; hydro-acoustic sensors; fan beam laser sensors; Artemis system signal sensors; vertical taut wire system sensors, horizontal taut wire system sensors; differential and absolute reference positioning system (DARPS) sensors.

6. The system of claim 1, wherein the dynamic positioning system further comprises at least one uninterruptible power source connected to the dynamic positioning system.

7. The system of claim 1, wherein the diesel hydraulic power unit is removably secured to the deck.

8. A semi-submersible vessel comprising at least two pairs of azimuthing thrusters as defined in claim 1.

9. The semi-submersible vessel of claim 8, wherein the semi-submersible vessel is a semi-submersible drilling vessel, a semi-submersible crane vessel, a floating dry dock, an accommodation vessel, a construction support vessel, a multi-column semi-submersible vessel, a semi-submersible work-over vessel, floatover vessel, or a space craft launching platform.

* * * * *